US008065828B2

(12) United States Patent
Bevers

(10) Patent No.: US 8,065,828 B2
(45) Date of Patent: Nov. 29, 2011

(54) SHEET MATERIAL DISPLAY APPARATUSES

(76) Inventor: Hal Bevers, Washougal, WA (US)

( * ) Notice: Subject to any disclaimer, the term of this patent is extended or adjusted under 35 U.S.C. 154(b) by 64 days.

(21) Appl. No.: 12/720,053

(22) Filed: Mar. 9, 2010

(65) Prior Publication Data

US 2010/0229440 A1 Sep. 16, 2010

Related U.S. Application Data

(60) Provisional application No. 61/209,758, filed on Mar. 11, 2009.

(51) Int. Cl.
*A47G 7/00* (2006.01)

(52) U.S. Cl. ..... 40/657; 40/618; 248/488

(58) Field of Classification Search ..... 40/657, 40/618, 124.4; 24/530, 564; 248/488
See application file for complete search history.

(56) References Cited

U.S. PATENT DOCUMENTS

| | | | | |
|---|---|---|---|---|
| 2,513,239 | A * | 6/1950 | Hatchett | 40/124.4 |
| 3,049,323 | A * | 8/1962 | Peterka | 248/466 |
| 3,452,959 | A * | 7/1969 | Sadao | 248/488 |
| 4,497,125 | A * | 2/1985 | Hutchinson | 40/657 |
| 5,267,405 | A * | 12/1993 | Seggerson | 40/618 |
| 5,397,092 | A * | 3/1995 | Black | 248/490 |
| 5,617,659 | A * | 4/1997 | Okubo | 40/545 |
| 5,987,791 | A * | 11/1999 | Paine | 40/124.4 |
| 7,540,105 | B2 * | 6/2009 | Case | 40/618 |
| 2003/0182833 | A1 * | 10/2003 | Lewis | 40/551 |
| 2008/0236005 | A1 * | 10/2008 | Isayev et al. | 40/574 |

* cited by examiner

*Primary Examiner* — Gary Hoge
(74) *Attorney, Agent, or Firm* — Mohr Intellectual Property Law Solutions, P.C.

(57) ABSTRACT

Display apparatuses for displaying a sheet material, including a panel including a front face and a rear face opposite the front face, a protuberance projecting from the front face, and a cap mounted to the protuberance in a position spaced from the front face to define a gap between the cap and the front face on at least one lateral side of the protuberance, wherein the gap has a thickness substantially similar to the thickness of the sheet material to secure the sheet material within the gap when the sheet material is inserted into the gap.

11 Claims, 1 Drawing Sheet

SHEET MATERIAL DISPLAY APPARATUSES

This application claims the benefit of U.S. Application, Ser. No. 61/209,758, filed on Mar. 11, 2009, which is hereby incorporated by reference for all purposes.

BACKGROUND

The present disclosure relates generally to display apparatuses. Display apparatuses are used to display sheet material, such as pictures, greeting cards, recipes, and the like. Display apparatuses are used in homes, such as in kitchens, living rooms, and bedroom, in offices, and in college dormitories, among a wide variety of other places.

Conventional solutions for displaying sheet material are not entirely satisfactory. For example, refrigerators are a common place to display photos and children's artwork with magnets used to secure the photos in place. However, magnets have limited holding strength and can fail to hold thicker sheet materials or more than one or two items of sheet material. Further, some refrigerator surfaces are not magnetically attractable, which makes magnet holders unusable.

Other known display apparatuses are limited in the number of items of sheet material they can display. Some conventional display apparatuses are not sufficiently portable. Still other known display apparatuses can not attach to items such as windows or metal surfaces.

Thus, there exists a need for display apparatuses that improve upon and advances the design of known display apparatuses. Examples of new and useful display apparatuses relevant to the needs existing in the field are discussed below.

SUMMARY

The present disclosure is directed to display apparatuses for displaying a sheet material, including a panel including a front face and a rear face opposite the front face, a protuberance projecting from the front face, and a cap mounted to the protuberance in a position spaced from the front face to define a gap between the cap and the front face on at least one lateral side of the protuberance, wherein the gap has a thickness substantially similar to the thickness of the sheet material to secure the sheet material within the gap when the sheet material is inserted into the gap.

DETAILED DESCRIPTION

The disclosed display apparatuses will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of examples of display apparatuses are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 2:
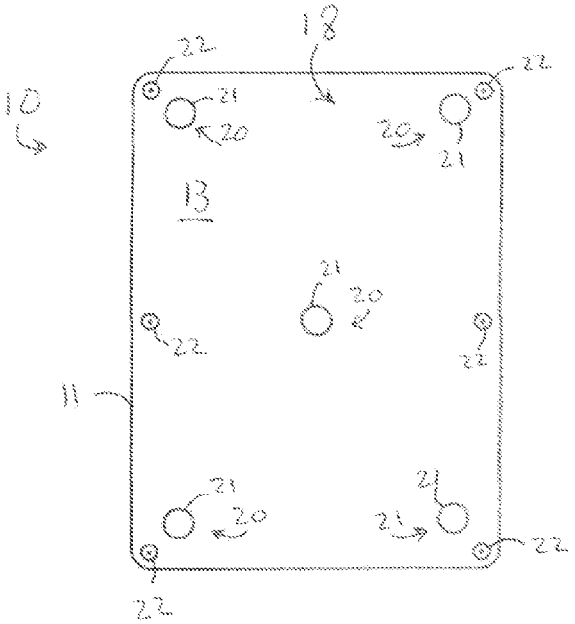
FIG. 2 is a bottom view of the display apparatus shown in FIG. 1.
Figure 1:
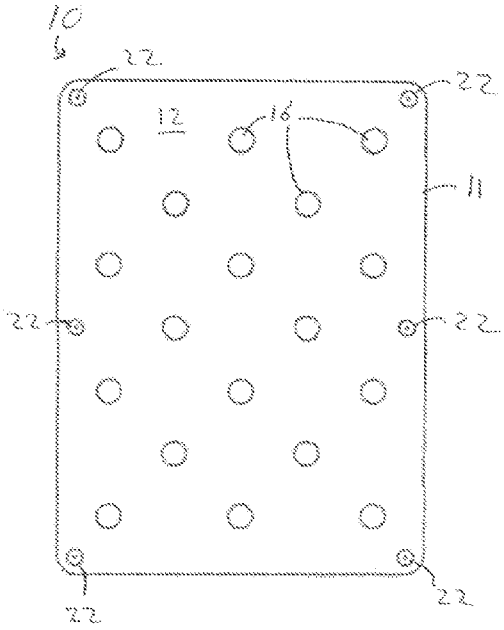
FIG. 1 is a top view of a first example of a display apparatus.

An example of a display apparatus 10 is illustrated in FIGS. 1 and 2. As illustrated in FIGS. 1 and 2, display apparatus 10 include a panel 11, which has a front surface 12 and a rear surface 13 opposite the front surface 12. The example illustrated in FIGS. 1 and 2 additionally includes a collection of protuberances 14 extending from front surface 12, with caps 16 attached to the ends of the protuberances 14 distal to front surface 12.

Figure 3:
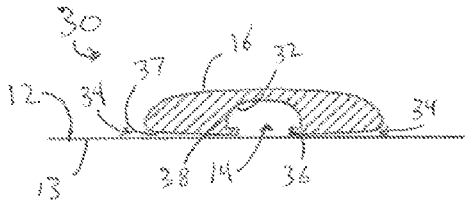
FIG. 3 is a cross-sectional view of a cap and protuberance.

With reference to FIG. 3, it can be seen that a bottom surface 37 of cap 16 and front surface 12 define a gap 34, into which sheet material may be secured. The example illustrated in FIGS. 1 and 2 additionally includes a fastener system 18 on rear surface 13. Fastener system 18 includes a series of fastening elements 20. In this particular example, fastening element 20 includes a magnet 21 for securing panel 11 to magnetically attractable items.

In the example shown in FIGS. 1-3, panel 11 is substantially rectangular in shape and has rounded corners. This shape is not required, and the panel may take any shape, including, but not limited to, elliptical shapes, polygonal shapes, or decorative non-polygonal shapes, such as hearts and silhouettes of illustrations. The panel need not be a closed shape, and open shapes or shapes with openings inside their perimeters are equally within this disclosure. The panel may have any combination of sharp or rounded corners.

The panel may support a variety of elements of display apparatuses. For example, FIG. 1 illustrates panel 11 supporting protuberances 14 and attached caps 16 on front surface 12. As shown in FIG. 2, panel 11 supports fastener system 18, which includes a collection of fastening elements 20, on the rear surface. FIGS. 1-3 demonstrate that display apparatus components may be affixed to front surface 12 or to rear surface 13 of panel 11. Additionally or alternatively, panel surfaces with no components affixed to them are equally within this disclosure.

The panel may be constructed out of any material suitable to support display apparatus elements. In the example shown in FIGS. 1-3, panel 11 is constructed using a flexible plastic. Other embodiments of the panel employ a more rigid material, such as a metal or a rigid plastic, if a lack of flexibility is desired.

Panel surfaces may be constructed out of a variety of different materials. In the embodiment shown in FIGS. 1-3, front surface 12 and rear surface 13 are constructed out of the same material as the rest of panel 11. However, other embodiments may have the front surface, the rear surface, or both constructed out of a different material than the rest of the panel.

In some embodiments, the panel surfaces may be constructed out of a plastic, either rigid or flexible. As another example, panel surfaces may be constructed of a tacky material, such as a rubber, or a rougher material, such as a rough plastic, to provide more friction on the surfaces and to better secure sheet material. As another example, panel surfaces may be constructed out of a soft material, such as a felt or cloth, to better secure sheet material and to prevent potential damage to sheet material while secured.

Additionally or alternatively, some embodiments may include combinations of different surface materials. As a non-limiting example, the aforementioned rubbers, plastics, felts, and cloths, may specifically be used on the areas of the front surface 12 proximate to gaps 34 used to secure sheet material. This may provide benefits including, but not limited to, better securing of sheet material and protection of sheet material. Panel surfaces made of any material may additionally have illustrations or designs displayed on the surface. In some embodiments, such illustrations may be illustrated as a print on the surface.

Additionally or alternatively, panel surfaces may have a topography that better secures sheet material. For example, panel surfaces may include a collection of raised features such as ridges or a rough surfaces to better secure sheet material.

In some embodiments, one or both of the panel surfaces may be constructed entirely out of a tacky substance and/or an adhesive as a means for attachment to an item. In some such embodiments, such a surface may include no additional elements, and the display apparatus may use this surface as a fastener. Such a design may obviate the need for a fastener, but designs that implement a fastener or fasteners in addition to a tacky surface are equally within this disclosure.

Additionally or alternatively, the panel may include one or more creases defining bending or folding locations. Such creases are defined by lines across the panel around which the panel may be folded. Creases may extend across the panel horizontally, vertically, or diagonally. Such creases may provide easier attachment of flexible display apparatuses around corners or irregularly shaped objects.

Panel 11 illustrated in FIGS. 1 and 2 a collection of holes 22. This non-limiting example illustrates a collection of six holes 22 placed generally around the perimeter of panel 11, but any number and arrangement of holes 22 is equally within this disclosure. Holes 22 are generally shaped and sized for receiving and securing suction cups, which are included in some examples of the fastening element. Holes 22 illustrated in FIGS. 1 and 2 are small and round in shape, but any shape or size may be designed to receive and secure different designs of suction cups. The holes may additionally or alternatively be designed to receive and secure fastening elements other than suction cups.

As shown in FIGS. 1 and 3, display apparatus 10 includes a collection of protuberances 14 projecting from front surface 12. FIG. 3 illustrates a cross section of an assembly 30 of a cap 16 and protuberance 14. Although the example in FIGS. 1 and 3 illustrate protuberances 14 projecting from front surface 12, the protuberances may project from the front surface, the rear surface, or both in other examples.

Protuberance 14 defines a stem 36 proximate front surface 12 and an attachment element 38 distal the front surface 12. In the embodiment shown in FIG. 3, attachment element 38 defines a boss complimentarily configured with a recess 32 in cap 16. Protuberance 14 projects at a distance that defines a gap 34 between front surface 12 and cap 16. Gap 34 has a thickness appropriate to secure sheet material. Protuberances of different lengths may be used to create gaps 34 of different thicknesses, allowing different types of sheet material to be secured.

As illustrated in FIG. 3, the end of protuberance 14 proximate front surface 12 defines a stem 36. However, no stem is required, and the protuberance may define only an attachment element 38.

Assembly 30 illustrated in FIG. 3 includes a protuberance 14 defining a boss complimentarily configured with recess 32 in cap 16. Any means for attaching a cap to a protuberance is equally within this disclosure.

In some embodiments, the cap and the attachment element are designed for repeated attachment and removal. Additionally or alternatively, the protuberance and the cap may be constructed as a single body. In other embodiments, the protuberance and the cap are constructed as to be permanently affixed to one another.

Additionally or alternatively, some embodiments lack an attachment element at the end of the protuberance distal to a panel surface. In these and other embodiments, the cap recess may be complimentarily configured with the stem. Display apparatuses may include any number or combination of protuberances of differing lengths and attachment elements, including those with or without stems or attachment elements.

FIG. 3 illustrates an example of an assembly 30 where cap 16 is mounted to the end of protuberance 14 projecting from front surface 12. Although this example illustrates protuberances 14 projecting from front surface 12, protuberances or caps may project from or be affixed to the front surface, the rear surface, or both. The caps may be made from many different materials, including, but not limited to, plastics, metals, rubbers, or any other substance suitable for securing sheet material.

As the example in FIG. 3 illustrates, caps 16 may be mounted to protuberances 14 by mating cap recess 32 with attachment element 38 of protuberance 14. Additionally or alternatively, caps 16 may be affixed directly to panel surfaces without attaching it to a protuberance 14. Caps in these embodiments may not require the use of a recess. Accordingly, caps with and without recesses are equally within this disclosure.

FIGS. 1 and 3 illustrate an example of a display apparatuses in which caps 16 extend radially around protuberance 14 to define a substantially round button. Such a design is not required, and the caps may take any shape suitable for securing sheet material, including, but not limited to, elliptical shapes, polygonal shapes, and decorative non-polygonal shapes, such as hearts and silhouettes of illustrations. The caps need not be closed shapes, and open shapes or shapes with openings inside their perimeters are equally within this disclosure. The caps additionally may have any combination of sharp or rounded corners.

In the example shown in FIG. 3, gap 34 tapers toward protuberance 14. However, this is not required, and the bottom surfaces of the caps may define gaps of many different designs. As an example, the cap bottom surface may be substantially parallel to a panel surface, creating a gap that is substantially flat. As an additional example, the cap bottom surface may have ridges or angles projecting from its surface.

Cap bottom surface 37 is made of the same material as the rest of the cap 16. However, the cap bottom surface 37 may additionally or alternatively be constructed of different surface materials. For example, the cap surface bottom may include materials including, but not limited to, tacky materials such as rubbers or soft materials such as felts or cloths. Such materials may allow the display apparatus to better secure sheet material or prevent potential damage to sheet material.

Fastener system 18 provides a means of securing a panel 11 to an item. Fastener system 18 includes a collection of fastener elements 20. As shown in FIG. 2, fastener elements 20 include magnets 21. Although fastener element 20 includes magnets 21 in this example, any suitable fastener element may be used, such as suction cups, adhesives, or penetrating members (e.g. spikes or tacks) configured to penetrate into the item. As previously discussed, panel 11 includes holes 22 that may be used to receive and secure suction cups or other fastener elements.

As additional examples, an embodiment with a fastener comprising adhesive could have adhesive applied directly to a panel surface or a collection of one or more adhesive members may be affixed to a panel surface. Display apparatuses may include none, one, or any combination of fastener elements. Additionally or alternatively, the fastener elements may be affixed to the front panel, the rear panel, or both. Embodiments where fastener elements are affixed on the same panel surface or the opposite panel surface as protuberances and caps are equally within this disclosure.

Additionally or alternatively, the fastener system may include no elements other than only the surface material of front surface 12 or rear surface 13. As an example, a rear surface 13 may be made of a tacky or sticky material such as a rubber. In such an embodiment, the surface material alone may be used to secure panel to an item.

Display apparatus 10 functions as a means to display sheet material. Generally, sheet material will have at least one section of its perimeter complimentarily sized with gap 34. For example, sheet material may include, but is not limited to, photos, cards, artwork, and coupons. Sheet material may include items that are substantially flat, have a curved profile, or have varying thicknesses at different parts of the item. Additionally or alternatively, sheet material may include items with one or more notched ends in which the notches are complimentarily sized with gaps 34.

As shown in FIG. 1, some of caps 16 are positioned proximate the peripheral edge of panel 11. The position of these caps enables display apparatus 10 to support sheet material that extends beyond the boundary of panel 11. As can readily be appreciated, supporting sheet material that extends beyond the boundary of panel 11 allows for more sheet material (or a greater total area of sheet material) to be supported.

Additionally or alternatively, some embodiments of the display apparatus may include only a panel and a collection of rings affixed to either the front surface or the rear surface of the panel. Such embodiments may or may not include fastener systems. A collection of rings may be affixed to a surface of the panel by adhesive. In such embodiments, gaps are defined in the areas between rings and the panel surface in which no adhesive has been applied. Sheet material may be secured to display apparatus in these gaps. Such a design may obviate the need for protuberances; however, protuberances may be affixed to rings and panel surfaces. Such use of protuberances allowing a greater variety of thicknesses of sheet material supported by the design.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A display apparatus for displaying a sheet material, comprising:

a panel including a front face and a rear face opposite the front face;

a plurality of protuberances projecting from the front face, the plurality of protuberances arranged in rows and columns; and a cap mounted to the protuberance in a position spaced from the front face to define a gap between the cap and the front face on at least one lateral side of the protuberance;

wherein the gap has a thickness substantially to the thickness of the sheet material to secure the sheet material within the gap when the sheet material is inserted into the gap; and wherein the protuberances in adjacent rows are positioned in offset columns.

2. The display apparatus of claim 1, further comprising a plurality of caps.

3. The display apparatus of claim 1, further comprising a fastener configured to secure the panel to an item with the ear face facing the item.

4. The display apparatus of claim 3, wherein the fastener includes a magnet.

5. A display apparatus for displaying a sheet material, the display apparatus comprising:

a panel including a front face and a rear face opposite the front face;

a protuberance projecting from the front face; and a cap mounted to the protuberance in a position spaced from the front face to define a gap between the cap and the front face on at least one lateral side of the protuberance;

wherein the gap has a thickness substantially similar to the thickness of the sheet material to secure the sheet material within the gap when the sheet material is inserted into the gap; and wherein the thickness of the gap tapers toward the protuberance.

6. The display apparatus of claim 5, wherein the cap removably mounts to the protuberance.

7. The display apparatus of claim 5, wherein the panel is a lightweight plastic material.

8. The display apparatus of claim 5, wherein the protuberance defines a stem proximate the front face and a boss distal the front face.

9. The display apparatus of claim 8, wherein the cap defines a recess that is complimentarily configured with the boss.

10. The display apparatus of claim 5, further comprising a second cap configured to mount to the protuberance in a position defining a second gap between the second cap and the front face, the second gap having a different thickness than the gap defined by the cap and the front face.

11. A display apparatus for displaying a sheet material, the display apparatus comprising:

a panel including a front face and a rear face opposite the front face;

a protuberance projecting from the front face; and a cap mounted to the protuberance in a position spaced from the front face to define a gap between the cap and the front face on at least one lateral side of the protuberance;

wherein the gap has a thickness substantially similar to the thickness of the sheet material to secure the sheet material within the gap when the sheet material is inserted into the gap; and wherein the cap mounts to the protuberance at the center of the cap and the cap extends radially out from the protuberance to define a round button.

* * * * *